US009249675B2

(12) United States Patent
Smith

(10) Patent No.: US 9,249,675 B2
(45) Date of Patent: Feb. 2, 2016

(54) PIN-FIN ARRAY

(71) Applicant: General Electric Company, Schnectady, NY (US)

(72) Inventor: Aaron Ezekiel Smith, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 14/453,366

(22) Filed: Aug. 6, 2014

(65) Prior Publication Data

US 2014/0348665 A1 Nov. 27, 2014

Related U.S. Application Data

(63) Continuation-in-part of application No. 13/221,009, filed on Aug. 30, 2011, now abandoned.

(51) Int. Cl.
*F01D 5/18* (2006.01)

(52) U.S. Cl.
CPC ..... *F01D 5/188* (2013.01); *F05D 2240/304* (2013.01); *F05D 2260/2212* (2013.01); *F05D 2260/2214* (2013.01)

(58) Field of Classification Search
CPC ..... F01D 5/18; F01D 5/186; F01D 5/187; F01D 5/189; F05D 2260/2214; F05D 2260/22141; F05D 2260/221; F05D 2260/2212; F05D 2240/304
See application file for complete search history.

(56) References Cited

U.S. PATENT DOCUMENTS

| | | | | |
|---|---|---|---|---|
| 5,158,136 | A | 10/1992 | Azar | |
| 5,611,670 | A | 3/1997 | Yoshinari et al. | |
| 6,254,334 | B1 * | 7/2001 | LaFleur | 415/115 |
| 6,481,966 | B2 * | 11/2002 | Beeck et al. | 416/97 R |
| 6,514,042 | B2 | 2/2003 | Kvasnak et al. | |
| 6,981,840 | B2 | 1/2006 | Lee et al. | |
| 7,121,787 | B2 * | 10/2006 | Jacks et al. | 415/115 |
| 7,837,440 | B2 | 11/2010 | Bunker et al. | |
| 2005/0169754 | A1 * | 8/2005 | Surace et al. | 416/97 R |
| 2007/0237639 | A1 * | 10/2007 | Cunha et al. | 416/97 R |
| 2010/0068066 | A1 | 3/2010 | Bunker | |
| 2011/0164960 | A1 | 7/2011 | Maldonado | |
| 2012/0020787 | A1 * | 1/2012 | Kruckels et al. | 416/1 |
| 2014/0086724 | A1 * | 3/2014 | Tibbott et al. | 415/1 |

* cited by examiner

*Primary Examiner* — Richard Edgar
*Assistant Examiner* — Juan G Flores
(74) *Attorney, Agent, or Firm* — Sutherland Asbill & Brennan LLP

(57) ABSTRACT

The present application provides an airfoil with a cooling flow therein. The airfoil may include an internal cooling passage, a number of cooling holes in communication with the internal cooling passage, and a number of pin-fins positioned within the internal cooling passage. The pin-fins are arranged with one or more turning openings and one or more guiding openings so as to direct the cooling flow towards the cooling holes.

18 Claims, 5 Drawing Sheets

PIN-FIN ARRAY

CROSS REFERENCE TO RELATED APPLICATIONS

This application is a continuation-in-part of U.S. patent application Ser. No. 13/221,009, filed Aug. 30, 2011, which is hereby incorporated by reference.

TECHNICAL FIELD

The present application and the resultant patent relate generally to gas turbine engines and more particularly relate to a flow guiding pin-fin array for use in gas turbine airfoils and the like.

BACKGROUND OF THE INVENTION

A gas turbine includes a number of stages with buckets extending outwardly from a supporting rotor disk. Each bucket includes an airfoil over which combustion gases flow. The airflow must be cooled to withstand the high temperatures produced by the combustion gases. Insufficient cooling may result in undue stress on the airfoil and may lead or contribute to fatigue and/or damage. The airfoil thus is generally hollow with one or more internal cooling flow channels. The internal cooling flow channels may be provided with a cooling air bleed from the compressor or elsewhere. Convective heat transfer may be enhanced between the cooling flow and the internal metal surfaces of the airfoil by the use of pin-fin arrays, turbulators, and the like. The pin-fin arrays or the turbulators create a disruption in a surrounding boundary layer so as to increase heat transfer.

An airfoil generally has a single cooling flow feed leading to a pin array and multiple outlets. Such a configuration, however, typically results in a flow through the pin array that is at an angle relative to the outlets. This angled flow may lead to a less effective heat transfer therein. Flow straighteners may be used but such add space and complexity to the pin array region.

There is thus a desire for an airfoil with an improved internal cooling flow scheme with a pin-fin array. Such an improved cooling flow scheme may provide a pin-fin array for more effective heat transfer, better flow control, and lower manufacturing costs.

SUMMARY OF THE INVENTION

The present application and the resultant patent provide an airfoil with an internal cooling passage configured to direct a cooling flow in a radially outward direction. The airfoil may include a number of cooling flow exit holes in communication with the internal cooling passage, such that the cooling flow can exit the internal cooling passage, and a number of pin-fins positioned in the internal cooling passage. The number of pin-fins may guide the cooling flow to the number of cooling flow exit holes. The number of pin-fins may include a first pin-fin, a second pin-fin, and a third pin-fin, each arranged in a row having a central axis. The first pin-fin may have a center point positioned at the central axis of the row, the second pin-fin may have a center point positioned offset from the central axis of the row by a first offset distance in a first direction, and the third pin-fin may have a center point positioned offset from the central axis of the row by a second offset distance in a second direction. The first offset distance may be different than the second offset distance.

The present application and the resultant patent provide an airfoil with a cooling flow inlet configured to allow a cooling flow to enter an internal cooling passage of the airfoil in an inlet direction, and a number of cooling flow exit holes in communication with the internal cooling passage. The airfoil includes a pin-fin array that may guide the cooling flow to the number of cooling flow exit holes. The pin-fin array may include a first pin-fin, a second pin-fin, and a third pin-fin, each arranged in a row having a central axis, the row positioned transverse to the inlet direction. The second pin-fin may have a center point positioned at the central axis of the row. The first pin-fin may have a center point positioned offset from the central axis of the row by a first offset distance in a first direction. The third pin-fin may have a center point positioned offset from the central axis of the row by a second offset distance in a second direction. The first offset distance may be different than the second offset distance.

These and other features and improvements of the present application and the resultant patent will become apparent to one of ordinary skill in the art upon review of the following detailed description when taken in conjunction with the several drawings and the appended claims.

DETAILED DESCRIPTION

Figure 1:
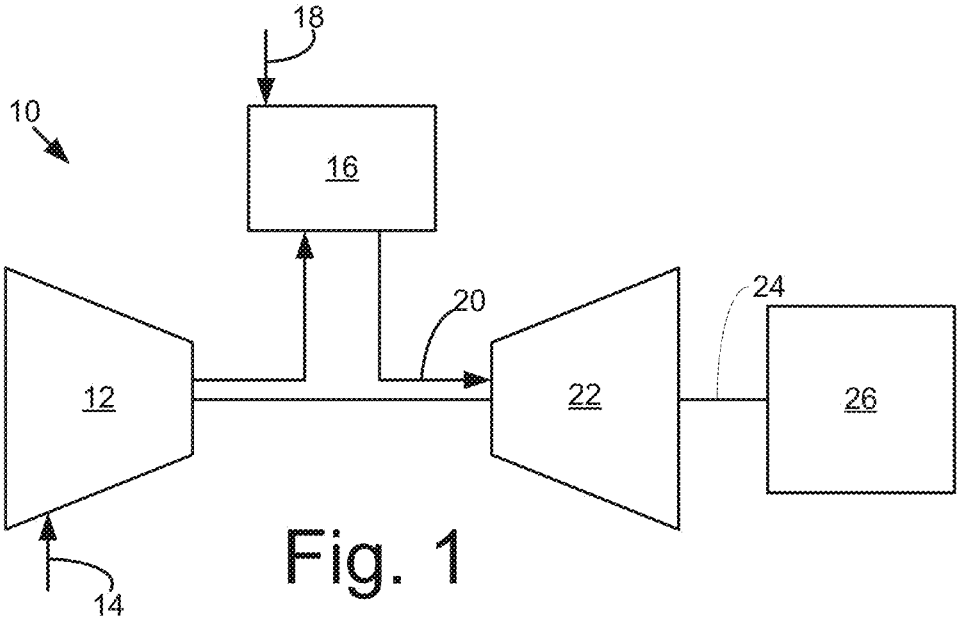
FIG. 1 is a schematic view of a gas turbine engine.

Referring now to the drawings, in which like numerals refer to like elements throughout the several views, FIG. 1 shows a schematic view of gas turbine engine 10 as may be used herein. The gas turbine engine 10 may include a compressor 12. The compressor 12 compresses an incoming flow of air 14. The compressor 12 delivers the compressed flow of air 14 to a combustor 16. The combustor 16 mixes the compressed flow of air 14 with a compressed flow of fuel 18 and ignites the mixture to create a flow of combustion gases 20. Although only a single combustor 16 is shown, the gas turbine engine 10 may include any number of combustors 16. The flow of combustion gases 20 is in turn delivered to a turbine 22. The flow of combustion gases 20 drives the turbine 22 so as to produce mechanical work. The mechanical work produced in the turbine 22 drives the compressor 12 via a shaft 24 and an external load 26 such as an electrical generator and the like.

The gas turbine engine 10 may use natural gas, various types of syngas, and/or other types of fuels. The gas turbine engine 10 may be any one of a number of different gas turbine engines offered by General Electric Company of Schenectady, N.Y., including, but not limited to, those such as a 7 or a 9 series heavy duty gas turbine engine and the like. The gas turbine engine 10 may have different configurations and may use other types of components. Other types of gas turbine engines also may be used herein. Multiple gas turbine engines, other types of turbines, and other types of power generation equipment also may be used herein together.

Figure 2:
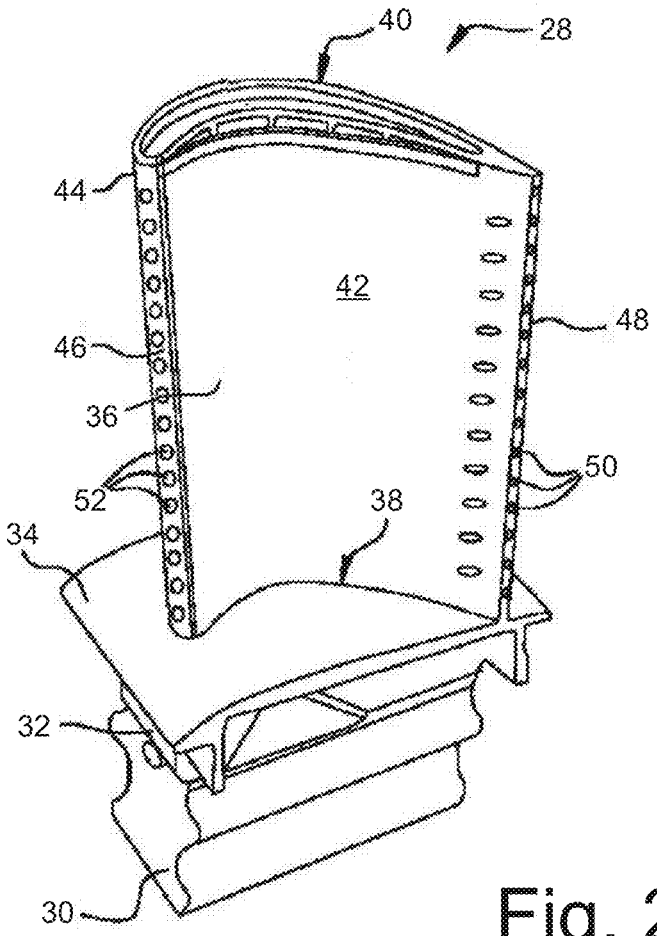
FIG. 2 is a perspective view of a turbine bucket.

FIG. 2 shows an example of a turbine bucket 28 that may be used with the turbine 22 described above. The turbine bucket 28 preferably may be formed as a one-piece casting of a super alloy. The turbine bucket 28 may include a conventional dovetail 30 attached to a conventional rotor disk. A blade shank 32 extends upwardly from the dovetail 30 and terminates in a platform 34 that projects outwardly from and surrounds the shank 32.

A hollow airfoil 36 extends outwardly from the platform 34. The airfoil 36 has a root 38 at the junction with the platform 34 and a tip 40 at its outer end. The airfoil 36 has a concave pressure sidewall 42 and a convex suction sidewall 44 joined together at a leading edge 46 and a trailing edge 48. The airfoil 36 may include a number of trailing edge cooling holes 50 and a number of leading edge cooling holes 52. The airfoil 36 and the turbine bucket 28 as a whole are described herein for the purposes of example only. The airfoil 36 and the turbine bucket 28 may have any size or shape suitable for extracting energy from the flow of combustion gases 20. Other components and other configurations may be used herein.

Figure 3:
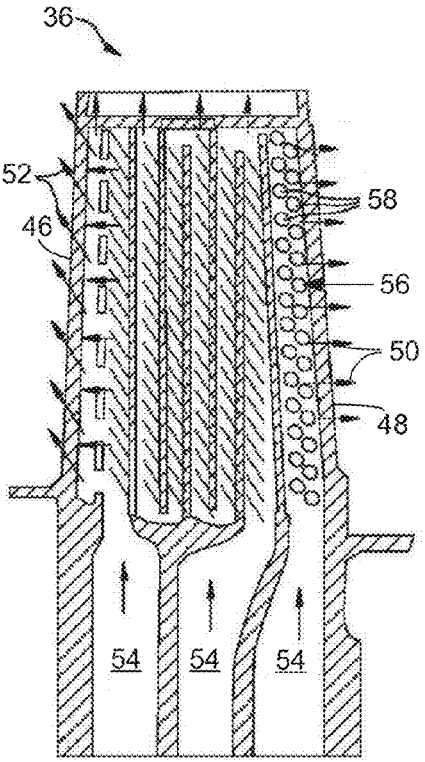
FIG. 3 is a side cross-sectional view of the turbine bucket of FIG. 2.

FIG. 3 shows a side cross-sectional view of the airfoil 36. As is shown, the airfoil 36 may include a number of internal cooling pathways 54. The airfoil 36 may be air cooled, steam cooled, open circuit, or closed circuit. The leading edge cooling hole 52 may be in communication with one or more of the internal cooling pathways 54. Likewise, the trailing edge cooling holes 50 may be in communication with one or more of the internal cooling pathways 54. One or more of the internal cooling pathways 54 also may include a pin array 56. The pin array 56 may be an array of pin-fins 58. The pin-fins 58 may have any desired size, shape, or configuration. In this example, the pin array 56 is positioned about the trailing edge cooling holes 50. Other types of heat transfer techniques may be used herein.

Figure 4:
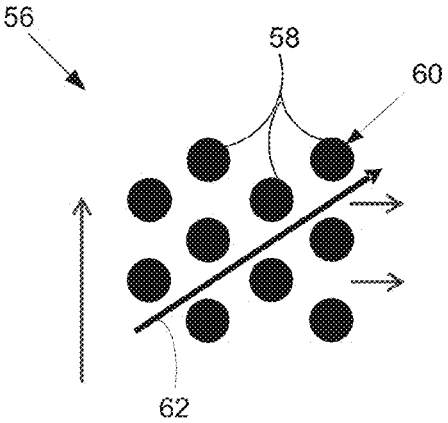
FIG. 4 is a schematic view of a known pin-fin array.

FIG. 4 shows an example of the pin array 56. In this example, the pin-fins 58 are arranged in a uniform array 60. As is shown, the pin-fins 58 are arranged with a generally uniform distance between each pin-fin 58. As a result, a cooling flow 62 may flow through the pin array 56 or other type of dump region at an angle relative to the trailing edge cooling holes 50. As described above, such an angle may compromise overall heat transfer.

Figure 5:
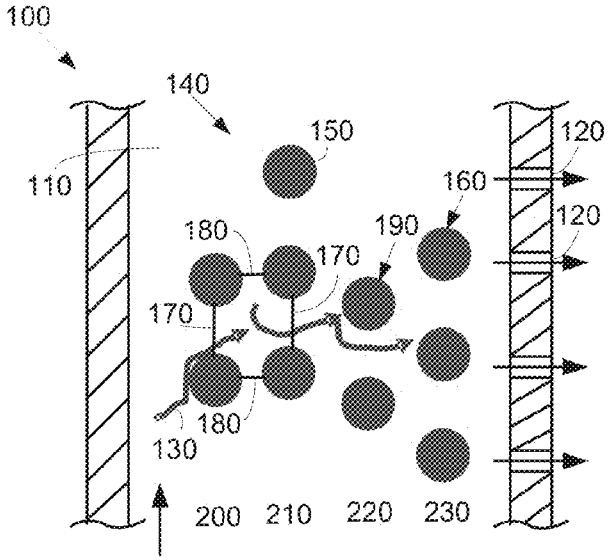
FIG. 5 is a schematic view of an example of a pin-fin array as may be described herein.

FIG. 5 shows a portion of an airfoil 100 as may be described herein. The airfoil 100 includes a number of internal cooling pathways 110 and a number of cooling holes 120 therethrough. A cooling flow 130 may flow through the internal cooling pathways 110 and exit via the cooling holes 120 so as to cool the airfoil 100. The cooling holes 120 may be positioned along the internal cooling pathway 110 such that the cooling flow 130 is required to make a turn in order to pass therethrough. Other configurations and other components may be used herein.

The airfoil 100 also includes a pin array 140 within one or more of the internal cooling pathways 110. The pin array 140 may includes a number of pin-fins 150. The pin-fins 150 may have any desired size, shape or configuration. Any number of the pin-fins 150 may be used. Other types of flow disrupters such as turbulators and the like also may be used herein.

In this example, the pin-fins 150 may be positioned in a non-uniform array 160. By the term "non-uniform" array 160, we mean that the distances between the individual pin-fins 150 may vary. Specifically, a turning opening 170 and a guiding opening 180 may be used between individual pin-fins 150. The turning opening 170 simply has a larger open area between the pin-fins 150 as compared to the guide opening 180. Specifically, the turning openings 170 may be about fifteen percent (15%) to about sixty percent (60%) larger than the guiding openings 180, although other ranges may be used herein. The larger open area of the turning openings 170 tends to turn the cooling flow 130 in the desired direction. The pin-fins 150 also may have a variable downstream staggered positioning 190. The variable downstream staggered positioning 190 also aids in directing the cooling flow 130 as desired. In the example shown, the pin array 140 may have a number of columns: a first column 200, a second column 210, a third column 220, and a fourth column 230. Any number of columns may be used herein. The staggered positioning 190 thus extends across the columns.

The cooling flow 130 thus turns into the turning opening 170 in the first column 200 and continues into the turning openings 170 of the second column 210, the third column 220, and the fourth column 230. The cooling flow 130 largely takes about a ninety (90) degree turn along the internal cooling pathway 110 into the cooling holes 120. The pin array 140 shown herein is for the purpose of example only. The positioning of the individual pin-fins 150 may vary according to the geometry of the airfoil 100, the internal cooling pathway 110, the cooling holes 120, the pin-fins 150, and the like. The positioning also may vary due to any number of different operational and performance parameters.

The use of the turning openings 170 so as to turn the cooling flow 130 thus results in a more effective pin array 140 for improved heat transfer and flow control. The cooling flow 130 will have significant momentum component normal thereto. The cooling flow 130 thus is efficiently directed into the cooling holes 120 or other dump region. Specifically, the cooling flow 130 stagnates alternatively on different pin rows so as to provide this direction. Moreover, the pin-fins 150 are positioned so as to optimize local flow velocity. Improved heat transfer may result in lower flow requirements and enhance increased overall efficiency. The pin array 140 also has larger pin spacings so as to reduce manufacturing costs and complexity while still providing effective heat transfer and flow control.

Figure 6:
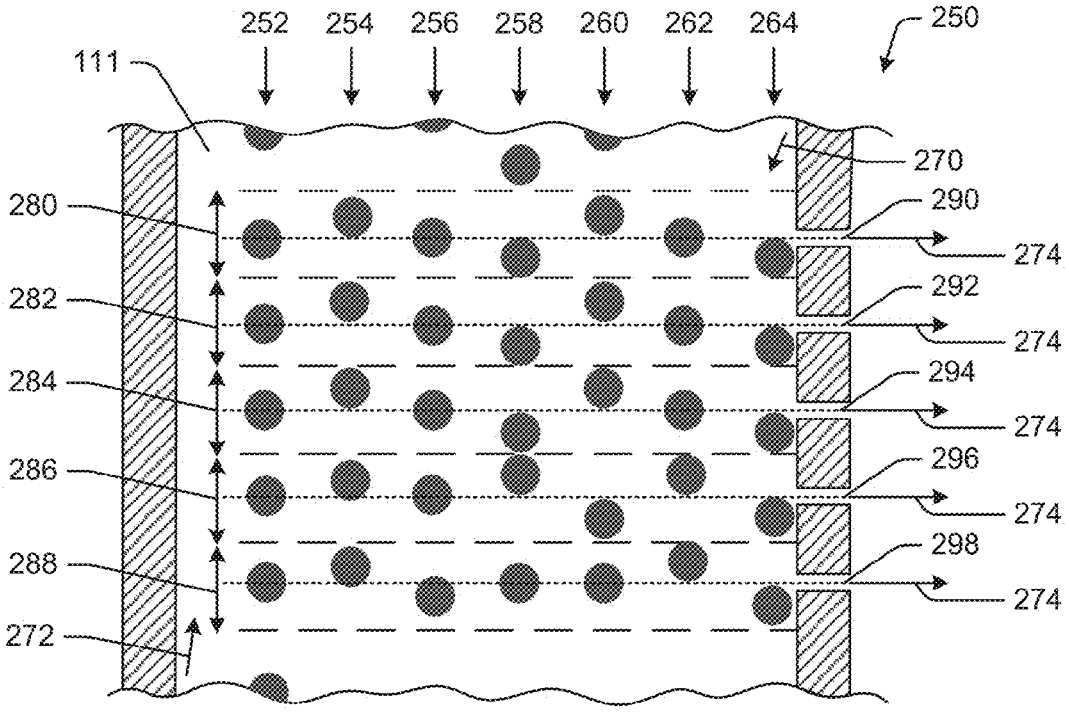
FIG. 6 is a schematic view of an alternate embodiment of a pin-fin array as may be described herein.

Referring now to FIG. 6, another embodiment of an airfoil 250 as described herein is illustrated. In this embodiment, a number of pin-fins 270 are positioned in the internal cooling passage 111 of the airfoil 250. The internal cooling passage 111 is configured to direct a cooling flow in a radially outward direction 272. The airfoil 250 includes a number of cooling flow exit holes 290-298 in communication with the internal cooling passage 111, such that the cooling flow may exit the internal cooling passage 111. The number of pin-fins 270 may be positioned in the internal cooling passage 111 and may be configured to guide the cooling flow to the number of cooling flow exit holes 290-298, such that the cooling flow is turned about 90 degrees from the radially outward direction 272 to exit direction 274, as the cooling flow exits the number of air exit holes 290-298.

The number of pin-fins 270 may be positioned in columns. For example, the number of pin-fins 270 may include a first column 252 of pin-fins with a number of pin-fins that are radially aligned, as shown in FIG. 6. The pin-fins in the first column 252 may have a radial spacing between adjacent pin-fins that is consistent or variable. The pin-fins in the first column 252 may be the furthest upstream column of the number of pin-fins 270. The number of pin-fins 270 may also include a second column 254, a third column 256, a fourth column 258, a fifth column 260, a seventh column 262, and an eighth column 264. Any number of columns may be used herein. As discussed with respect to the first column 252, the pin-fins in the second through eighth columns 254-264 may have a number of radially aligned pin-fins, where the radial spacing between adjacent pin-fins is consistent or variable. Additionally, the radial spacing in one column may be different than the radial spacing in another column. The eighth column 264 may be the furthest downstream column of the number of pin-fins 270. In other embodiments, additional or fewer columns may be included.

The number of pin-fins 270 may be arranged in rows. For example, as illustrated in FIG. 6, the number of pin-fins 270 may include a first row 280, a second row 282, a third row 284, a fourth row 286, and a fifth row 288. Any number of rows may be used herein. Each row 280-288 may include a number of pin-fins positioned anywhere within the row. Each row may have a central axis indicating a center of the respective row, as shown in FIG. 6. In some embodiments, each row may have a corresponding cooling flow exit hole. In such embodiments, the corresponding cooling flow exit hole may be aligned with the central axis of the row. For example, in FIG. 6, cooling flow exit hole 290 may correspond to the first row 280, cooling flow exit hole 292 may correspond to the second row 282, cooling flow exit hole 294 may correspond to the third row 284, cooling flow exit hole 296 may correspond to the fourth row 286, and cooling flow exit hole 298 may correspond to the fifth row 288. In other embodiments, rows may not include corresponding cooling flow exits holes, or the cooling flow exit holes may not be aligned with the central axis of the row.

The positioning of the pin-fins in each respective row 280-288 may affect the amount of redirection imparted on the cooling flow, as well as residence time in the internal cooling passage 111, as the cooling flow impacts the pin-fins. Accordingly, by manipulating positioning of the pin-fins in each row 280-288, the cooling flow may be made to turn about 90 degrees from radially outward direction 272 to exit direction 274. If turns or redirection angles other than 90 degrees are desired, such redirection may also be managed using the airfoils and pin-fin arrangements described herein and below.

Figure 7:
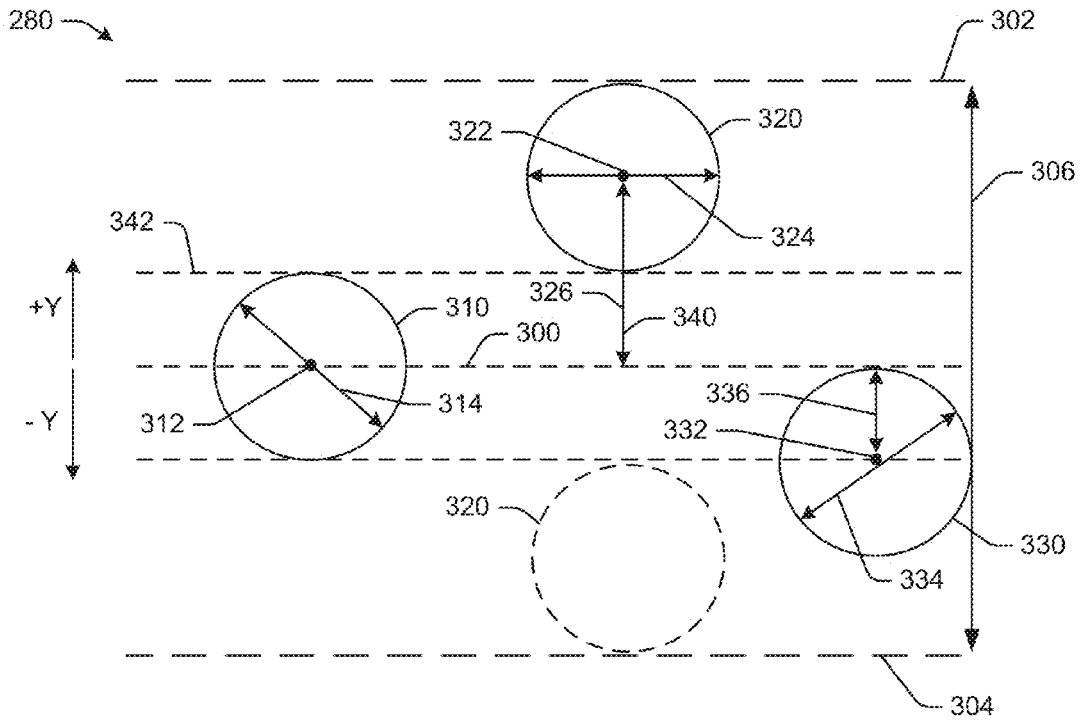
FIG. 7 is a schematic close-up view of a portion of the pin-fin array of FIG. 6.

Referring now to FIG. 7, a portion of the first row 280 of pin-fins in the number of pin-fins 270 is illustrated. The illustrated portion of the first row 280 includes a central axis 300 and a first pin-fin 310, a second pin-fin 320, and a third pin-fin 330. The first row 280 includes an upper end 302 and a lower end 304, both symmetric about the central axis 300. The first, second, and third pin-fins 310, 320, 330 are positioned within the upper and lower ends 302, 304 of the first row 280. The first row 280 includes a height 306, measured from the upper end 302 to the lower end 304.

In some embodiments, such as the embodiment illustrated in FIG. 7, the pin-fins 310, 320, 330 may be circular, and may therefore have a diameter. The first pin-fin 310 may have a first diameter 314, the second pin-fin 320 may have a second diameter 324, and the third pin-fin 330 may have a third diameter 334. Some or all of the first, second, and third diameters 314, 324, 334 may be equal in some embodiments, and unequal in other embodiments. The height 306 of the first row 280 may be associated with the diameters 314, 324, 334 of the pin-fins 310, 320, 330 positioned in the first row 280. For example, the height 306 may be equal to three times the diameter 314 of the first pin-fin 310.

Each of the first, second, and third pin-fins 310, 320, 330 includes a center point. Specifically, the first pin-fin 310 has center point 312, the second pin-fin 320 has center point 322, and the third pin-fin 330 has center point 332. The center points 312, 322, 332 indicate a center of each respective pin-fin 310, 320, 330. In some embodiments, some or all of the pin-fins 310. 320, 330 may have alternate geometries, such as rectangular, and may therefore not have diameters. However, such pin-fins will still have discernible center points, which may be determined as a center of mass of the pin-fin, among other methods.

In the illustrated embodiment, the first pin-fin 310 is positioned in the first row 280 such that the center point 312 of the first-pin fin 310 is positioned at the central axis 300 of the first row 280. The second pin-fin 320 is positioned downstream of the first pin-fin 320. The center point 322 of the second pin-fin 320 is positioned offset from the central axis 300 by a first offset distance 326 in a first direction, or the +Y direction as indicated in FIG. 7. For ease of illustration, the second pin-fin 320 is also illustrated positioned at the same first offset distance 326, but in the opposite direction, or the −Y direction. In some embodiments, the second and third pin-fins 320, 330 may be offset in the same direction. The third pin-fin 330 is positioned downstream of the second pin-fin 320. The center point 332 of the third pin-fin 330 is positioned offset from the central axis 300 by a second offset distance 336 in a second direction, or the −Y direction, opposite the first direction. For example, the center point 332 of the third pin-fin 330 may be aligned with a bottom of the first pin-fin 310, or may not be. In some embodiments, the second and third pin-fins 320, 330 may be offset in the same direction. In the illustrated embodiment, the first offset distance 326 is different than the second offset distance 336. Specifically, the first offset distance 326 is greater than the second offset distance 336 in FIG. 7. In some embodiments, the first offset distance 326 may be less than or equal to the second offset distance 336.

The second and third pin-fins 320, 330 may be offset in any direction and by any distance up to a maximum offset distance 340 determined by the upper and lower ends 302, 304 of the first row 280, and/or the height 306 of the first row. In some embodiments, such as the embodiment illustrated in FIG. 7, the maximum offset distance 340 may be equal to a diameter 314 of the first pin-fin 310. In such embodiments, when the second pin-fin 320 is offset the maximum distance, for example in the +Y direction as shown, the bottom of the second pin-fin 320 may be aligned with the top of the first pin-fin 310, as illustrated by dashed line 342, and the top of the second pin-fin 320 may be aligned with the upper end 302 of the first row 280.

In other embodiments, the maximum offset distance 340 may be equal to the diameter 324, 334 of the second or third pin-fins 330, 340 positioned in the first row 280. In yet other embodiments, the maximum offset distance 340 may be based on a height of a pin-fin positioned within the row. In other embodiments, the second pin-fin 320 may be offset by a distance that is less than the maximum offset distance 340, and the third pin-fin 330 may be offset by zero, or may not be offset. In some embodiments, both the second and third pin-fins 320, 330 may be offset by a distance less than the maximum offset distance 340. In some embodiments, the third pin-fin 330 may be offset by a distance greater than the offset distance of the second pin-fin. Although discussed with respect to the first row 280, it is understood that discussion herein is applicable to the remaining rows, as well as the columns 252-264 discussed above.

Figure 8:
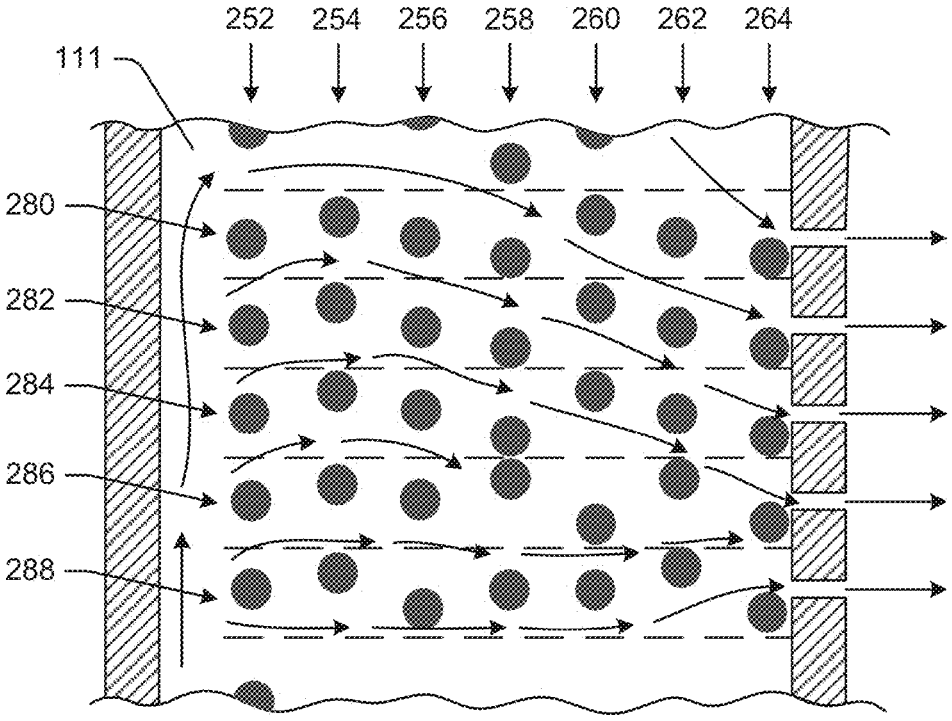
FIG. 8 is a schematic view of an example of cooling flow flowing through the pin-fin array of FIG. 6.

Referring now to FIG. 8, a simplified drawing of FIG. 6 is depicted. As shown, by manipulating the offsets for successive pin-fins in discrete rows, the cooling flow may be turned, as illustrated by the arrows. By offsetting pins in rows, which may include non-uniform offsets, greater control over fluid dynamics of the cooling flow may be achieved. For example, while rows 280-284 turn the cooling flow about 90 degrees, rows 286 and 288 allow the cooling flow to pass through relatively unaffected. By adjusting grouping between multiple rows, turbulent flow may be achieved by reducing the pathways available for the cooling flow to pass there through.

The offset pin-fin arrangement described herein may result in manipulation and control of cooling flow as the cooling flow passes through an internal cooling passage. The direction and residence time of the cooling flow are at least two aspects of the fluid dynamics of the cooling flow that may be manipulated herein. Manipulation of the cooling flow may result in improved heat transfer within the cooling passage.

It should be apparent that the foregoing relates only to certain embodiments of the present application and the resultant patent. Numerous changes and modifications may be made herein by one of ordinary skill in the art without departing from the general spirit and scope of the invention as defined by the following claims and the equivalents thereof.

I claim:

1. An airfoil comprising:

an internal cooling passage configured to direct a cooling flow in a radially outward direction;

a plurality of cooling flow exit holes in communication with the internal cooling passage, such that the cooling flow can exit the internal cooling passage; and a plurality of pin-fins positioned within discrete rows in the internal cooling passage, the plurality of pin-fins configured to guide the cooling flow to the plurality of cooling flow exit holes, wherein each of the plurality of pin-fins is positioned entirely within one of the discrete rows, and wherein:

the plurality of pin-fins comprises a first pin-fin, a second pin-fin, and a third pin-fin arranged and positioned within a row of the discrete rows, the row having a central axis;

the first pin-fin has a center point positioned at the central axis of the row;

the second pin-fin has a center point positioned offset from the central axis of the row by a first offset distance in a first direction;

the third pin-fin has a center point positioned offset from the central axis of the row by a second offset distance in a second direction, wherein the first direction is opposite the second direction;

the first offset distance is different than the second offset distance; and the first pin-fin is adjacent to the second pin-fin and the third pin-fin is adjacent to the second pin-fin.

2. The airfoil of claim 1, wherein a maximum offset distance is equal to a diameter of the first pin-fin.

3. The airfoil of claim 2, wherein the first offset distance is less than the maximum offset distance and the second offset distance is the maximum offset distance.

4. The airfoil of claim 2, wherein the first offset distance and the second offset distance are less than the maximum offset distance.

5. The airfoil of claim 1, wherein the first pin-fin, the second pin-fin, and the third pin-fin have equal diameters.

6. The airfoil of claim 1, wherein the row has a height equal to two times a diameter of the first pin-fin.

7. The airfoil of claim 1, wherein the first offset distance is greater than the second offset distance.

8. The airfoil of claim 1, wherein the second pin-fin is positioned downstream of the first pin-fin.

9. The airfoil of claim 8, wherein the third pin-fin is positioned downstream of the second pin-fin.

10. An airfoil comprising:

a cooling flow inlet configured to allow a cooling flow to enter an internal cooling passage of the airfoil in an inlet direction;

a plurality of cooling flow exit holes in communication with the internal cooling passage; and a pin-fin array configured to guide the cooling flow to the plurality of cooling flow exit holes comprising:

a plurality of pin-fins comprising a first pin-fin, a second pin-fin, and a third pin-fin, wherein each of the plurality of pin-fins is positioned entirely within one of a plurality of discrete rows;

wherein the first pin-fin, the second pin-fin, and the third pin-fin are each arranged in a row of the plurality of discrete rows, the row having a central axis and positioned transverse to the inlet direction;

wherein the second pin-fin has a center point positioned at the central axis of the row;

the first pin-fin has a center point positioned offset from the central axis of the row by a first offset distance in a first direction;

the third pin-fin has a center point positioned offset from the central axis of the row by a second offset distance in a second direction, wherein the first direction is opposite the second direction;

the first offset distance is different than the second offset distance; and the first pin-fin is adjacent to the second pin-fin and the third pin-fin is adjacent to the second pin-fin.

11. The airfoil of claim 10, wherein a maximum offset distance is equal to a diameter of the first pin-fin.

12. The airfoil of claim 11, wherein the first offset distance is less than the maximum offset distance and the second offset distance is the maximum offset distance.

13. The airfoil of claim 11, wherein the first offset distance and the second offset distance are less than the maximum offset distance.

14. The airfoil of claim 10, wherein the first pin-fin, the second pin-fin, and the third pin-fin have equal diameters.

15. The airfoil of claim 10, wherein the row has a height equal to two times a diameter of the first pin-fin.

16. The airfoil of claim 10, wherein the first offset distance is greater than the second offset distance.

17. The airfoil of claim 10, wherein the second pin-fin is positioned downstream of the first pin-fin.

18. The airfoil of claim 17, wherein the third pin-fin is positioned downstream of the second pin-fin.

* * * * *